United States Patent [19]

Le Bras

[11] Patent Number: 4,756,419

[45] Date of Patent: Jul. 12, 1988

[54] MULTIPACK FOR A TWO TIER GROUP OF CONTAINERS

[75] Inventor: Philippe Le Bras, Chateauroux, France

[73] Assignee: The Mead Corporation, Dayton, Ohio

[21] Appl. No.: 58,218

[22] Filed: Jun. 4, 1987

[30] Foreign Application Priority Data

Jun. 19, 1986 [GB] United Kingdom ..... 8614975

[51] Int. Cl.[4] ..... B65D 75/28

[52] U.S. Cl. ..... 206/430; 206/140; 206/196; 229/40

[58] Field of Search ..... 206/427, 429, 432, 434, 206/139, 140, 193, 194, 196, 499, 430; 229/15, 23 R, 40

[56] References Cited

U.S. PATENT DOCUMENTS

| | | | |
|---|---|---|---|
| 1,170,729 | 2/1916 | Beckstrom | 229/15 |
| 1,801,998 | 4/1931 | Boeye | 229/15 |
| 2,187,382 | 1/1940 | Libbey | 229/15 |
| 2,738,917 | 3/1956 | Mader | 229/15 |
| 3,139,980 | 7/1964 | Spery | 229/40 |
| 3,347,365 | 10/1967 | Funkhouser | 206/432 X |
| 3,352,453 | 11/1967 | Weiss | 206/196 X |
| 3,372,800 | 3/1968 | Arneson | 229/40 |
| 3,381,881 | 5/1968 | Ganz et al. | 229/40 |
| 4,164,286 | 8/1979 | Sutherland | 206/434 |
| 4,596,356 | 6/1986 | Chaussadas | 229/40 |

*Primary Examiner*—Stephen Marcus
*Assistant Examiner*—Bryon Gehman

[57] ABSTRACT

A package accommodating a group of containers arranged in two tiers has an upper tier and a lower tier each comprising a plurality of like containers disposed in more than one row (R1,R2,R3,R4). The package includes an outer wrapper (10) which secures all the containers of the group together in a unit and a partition (50) provided between the bases of the containers in the upper tier and the tops of the containers in the lower tier. The wrapper includes bottom panels (12,20) on which the bases of the containers in the lower tier are seated. The partition and the bottom panels each include a keel (K1,K2) adapted to separate the containers in one row from those in an adjacent row in the upper and lower tiers and each of the keels have recesses (A,O) to separate one container from a neighboring container in each of the rows of containers.

4 Claims, 4 Drawing Sheets

MULTIPACK FOR A TWO TIER GROUP OF CONTAINERS

This invention relates to a package accommodating a group of containers arranged in two tiers in which both an upper and a lower tier comprises a plurality of like containers disposed in more than one row.

The package includes a wrapper which secures all the containers of the group together in a unit and a partition between the two tiers which protects the tops of the containers in the lower tier and correctly spaces the containers of the upper tier.

The invention provides a package accommodating a group of containers arranged in two tiers in which both an upper tier and a lower tier each comprise a plurality of like containers disposed in more than one row, the package including an outer wrapper which secures all the containers of the group together in a unit and a partition provided between the bases of the containers in the upper tier and the tops of the containers in the lower tier, said wrapper including bottom panel means on which the bases of the containers in the lower tier are seated, characterized in that the partition and bottom panel means includes a keel adapted to separate the containers in one row from those in an adjacent row in respective ones of the upper and lower tiers of containers each of said keels including means to separate one container from a neighbouring container in each of the rows of containers.

An embodiment of the invention will now be described, by way of example, with reference to the accompanying drawings, in which.

Figure 1:
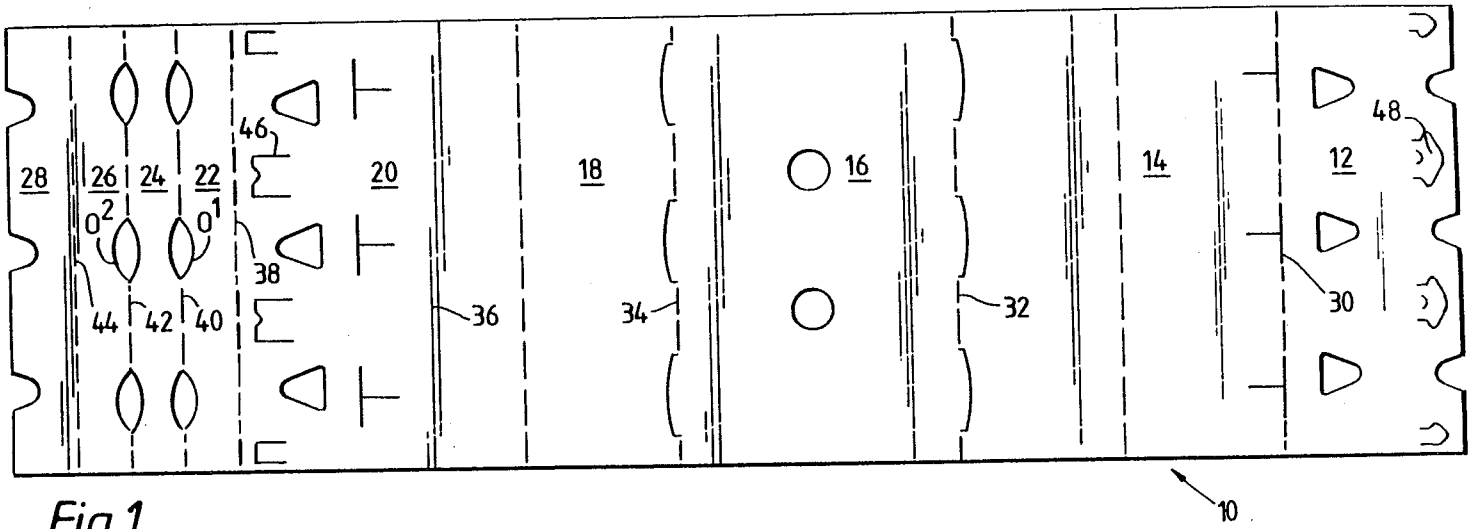
FIG. 1 is a plan view of a wrapper blank for forming a part of the package according to the invention.
Figure 2:
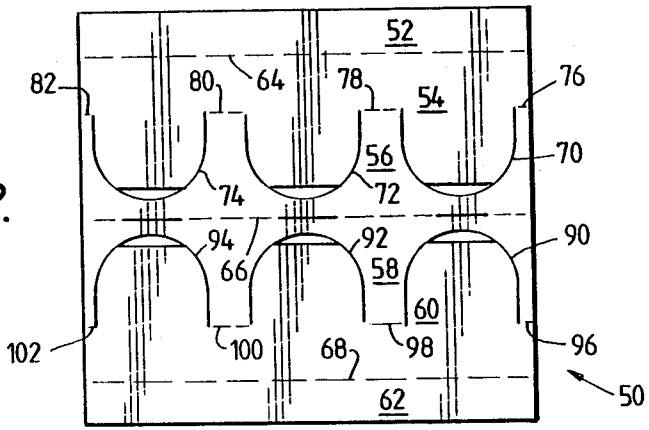
FIG. 2 is a plan view of a partition blank for forming a part of the package according to the invention.
Figure 3:
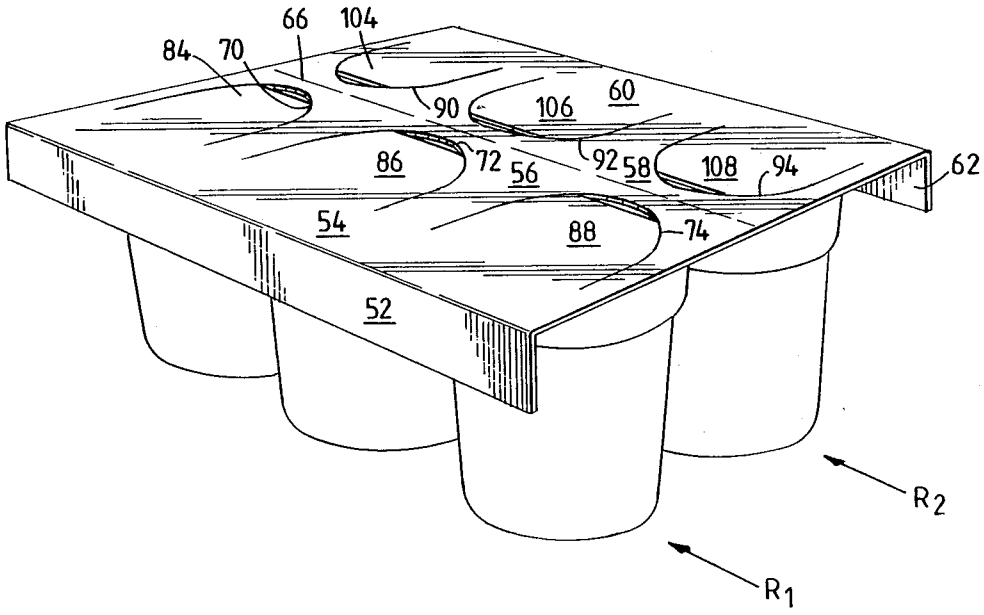
FIG. 3 is a perspective view of a group of containers to the lids of which the partition blank has been applied.
Figure 4:
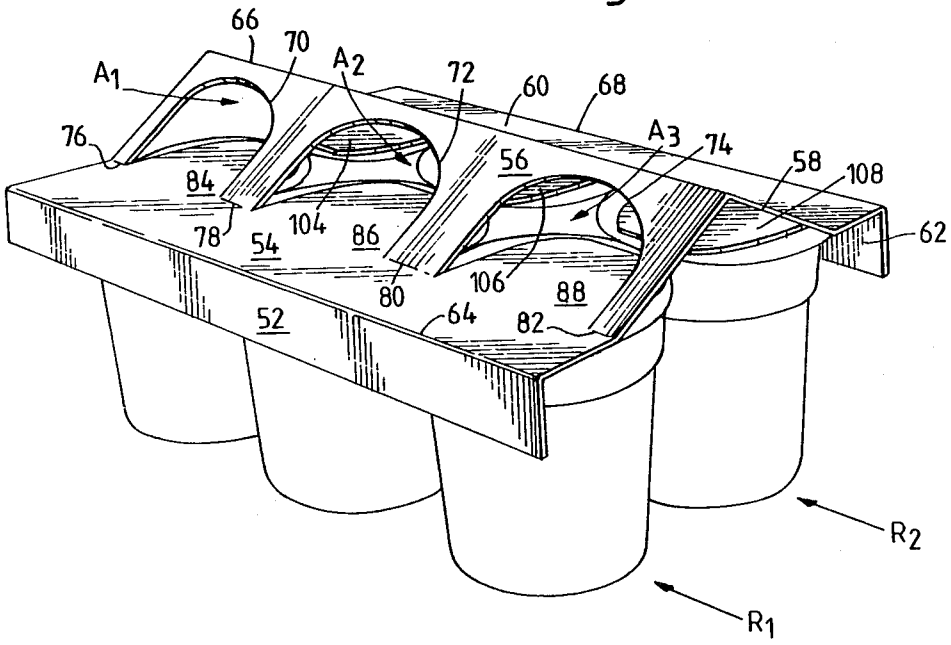
FIG. 4 is a perspective view similar to FIG. 3 but in which a keel has been formed by a central raised part of the partition blank.

The wrapper blank 10 is formed from a single sheet of paperboard or similar foldable sheet material and comprises, in series, a first base panel 12; a first side wall panel 14; a top panel 16; a second side wall panel 18; a second base panel 20; a first keel side wall 22; a keel top wall 24; a second keel side wall 26 and an end panel 28 hinged one to the next along transverse fold lines 30–44 respectively.

The first and second keel side wall 22 and 26 together with the keel top wall 24 provide a central keel 'K' in the completed package which spaces apart rows $R^1$, $R^2$ of cups and also locates, at least partially, the individual cups in each row. In order to provide for the location of each cup a row $0^1$, $0^2$ of generally ovate apertures is struck from the blank along fold lines 40 and 42 respectively. The apertures in row $0^1$ are therefore provided by material removed partially from keel side wall 22 and keel top wall 24. Similarly, the apertures in row $0^2$ are provided by material removed partially from keel side wall 26 and keel top wall 24. The transverse fold lines 40 and 42 contain the major axes of the rows of apertures $0^1$ and $0^2$ and the arcuate perimeter of each aperture on either side of its major axis has a different radius of curvature.

When the keel is erected the apertures form scalloped recesses on either side of keel K each to receive and locate a peripheral wall portion of a cup. In order to erect the centre keel K the blank is folded about fold lines 38, 40, 42 and 44, so that the adjacent edges (defined by fold lines 38 and 44) of base panel 20 and end panel 28 are drawn into abutting relationship. The panels of the keel are sized so that when the base panels are drawn together, the keel K will form a transverse structure of triangular cross-section in which the keel side walls 22 and 26 are convergent away from the keel top wall 24 to terminate in the apex of the triangle. The keel top wall lies in a plane parallel to the base panels of the package. In order to maintain the keel in its erected condition, the end panel may be secured e.g. by gluing, to the base panel 12. As is well known in the art, in order to maintain the wrapper blank wrapped about the packaged articles, locking elements are provided to lock together the base panels. In this regard, base panel 20 is formed with hinged retaining tabs which define locking apertures 46 at spaced locations adjacent keel side panel 22 and cooperating locking tabs 48 are struck from base panel 12. The locking tabs are inserted into the locking apertures in known manner to lock the base panels together in overlapping relationship.

The partition blank 50 is formed from a single sheet of paperboard or similar foldable sheet material and comprises a first side panel 52; a first divider panel 54; a first keel side wall 56; a second keel side wall 58; a second divider panel 60 and a second side panel 62. First side panel 52 is hinged to first divider panel 54 along fold line 64. The first and second keel panels are hinged together along fold line 66 and the second divider panel is hinged to the second side panel 62 along fold line 68. Arcuate cut lines 70, 72 and 74 are struck from the partition blank so that divider panel 54 is hinged to first keel side wall 56 along short fold lines 76, 78, 80 and 82. The arcuate cut lines define arched apertures $A^1$–$A^3$ in the first keel side wall when it is raised relative to divider panel 54 which provide the first divider panel with a series of platforms 84, 86 and 88 respectively.

On the other side of the central fold line 66, the partition blank is of like arrangement. Thus, arcuate cut lines 90, 92 and 94 are struck from the blank so that divider panel 60 is hinged to second keel side wall 58 along short fold lines 96, 98, 100 and 102. The arcuate cut lines define arched apertures A4–A6 in the second keel side wall when it is raised relative to divider panel 60 which provides the second divider panel with a series of platforms 104, 106 and 108 respectively.

Figure 5:
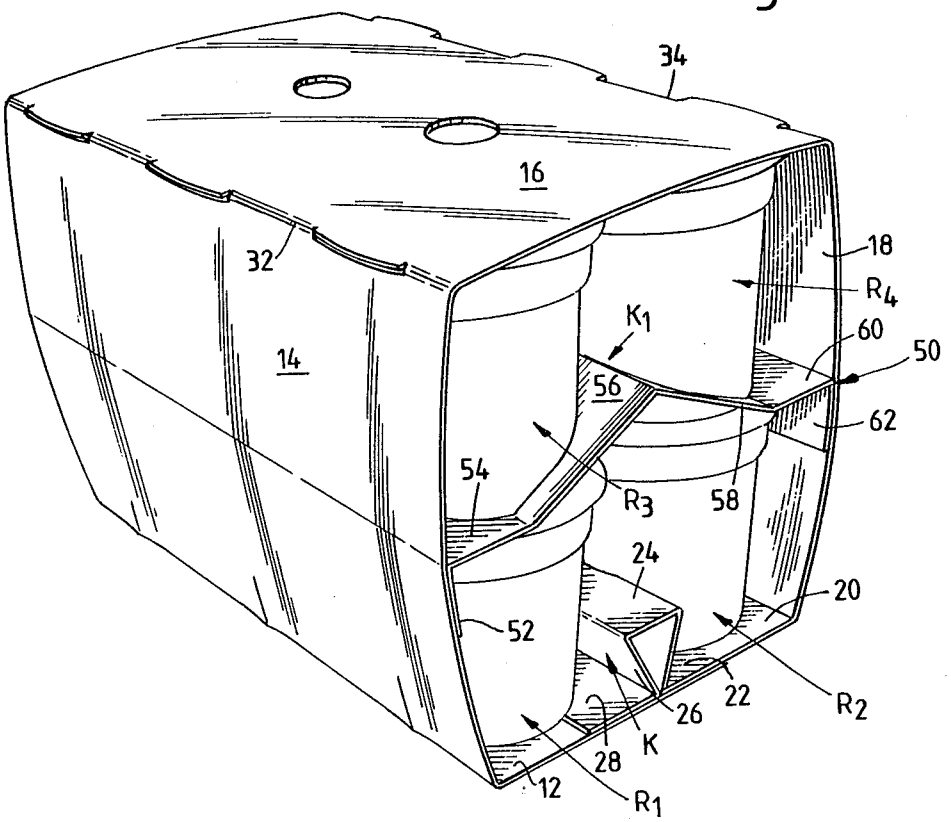
FIG. 5 is a perspective view of the completed package according to the invention.

In order to form the two tier package shown in FIG. 5, first the partition blank is laid onto the lower group of cups which are arranged in two rows $R^1$, $R^2$ and the first and second side wall panels 52 and 62 folded downwardly so that they flank portions of the cup bodies. The side wall panels facilitate correct positioning of the partition relative to the cups. The blank is then reduced in width by displacing the first and second keel side walls 56, 58 upwardly about central fold line 66. Two upper rows $R^3$, R4 of cups are seated on the platforms of the divider panels which overlie the lids of respective ones of the cups in the lower rows $R^1$, $R^2$. The keel side walls form an upper keel $K^2$ between the rows of cups in the upper rows so that each cup has a lower body portion received in a respective one of the arched apertures $A^1$–$A^3$ and A4–A6.

The wrapper blank 10 is then applied to the two-tier stack of cups which are separated by the partition, in known manner, so that the top panel 16 overlies the tops of the cups in upper rows $R^3$ and R4 and the base panels are secured together beneath lower rows $R^1$ and $R^2$ with the keel therebetween as previously described.

During application of the wrapper blank retaining slits 'S' which are struck from the blank along fold lines 30, 32, 34 and 36 engage flange and base portions of the cups in order to assist in the retention of the cups from endwise dislodgement from the package. Also, carrying apertures 110 are struck from top panel 16 of the wrapper blank to facilitate portage of the package.

I claim:

1. A package for accommodating a group of cup-shaped containers arranged in two tiers, each tier comprising a plurality of containers disposed in at least two adjacent rows, the package including an outer wrapper which secures all the containers of the group together in a unit and comprises a top wall, opposing side walls and a bottom wall, and a partition horizontally disposed between the bases of the containers in the upper tier and the tops of the containers in the lower tier, said partition being formed from a sheet of foldable material having spaced longitudinal side edges and transverse end edges and comprising divider panels (54,60) extending inwardly from the longitudinal side edges of said partition and overlying at least a portion of the cups in the lower tier, upwardly inclined keel panels (56,58) hinged to the divider panels at fold lines remote from said side edges, said keel panels being joined to each other to form a longitudinal keel (K1), and arched apertures (A1–A6) formed in said keel panels in spaced relationship so as to provide longitudinal and transverse separation of the containers in the upper tier, characterized in that a series of platforms is provided from material struck from said keel panels to form said apertures, each platform extending inwardly from said divider panel and overlying the tops of a respective one of the containers in the lower tier to support the base of respective ones of the containers in the upper tier.

2. The package of claim 1, further characterized in that said partition includes side panels joined to the side edges of the partition and extending downwardly along the side walls of said wrapper.

3. The package of claim 1, further characterized in that the containers in the lower tier are separated by a bottom keel extending longitudinally between the two adjacent rows of containers.

4. The package of claim 3, further characterized in that said bottom wall is formed from two overlapping base panels and said bottom keel is integral with one of the base panels.

* * * * *